US007699304B2

(12) United States Patent
Yamamoto et al.

(10) Patent No.: US 7,699,304 B2
(45) Date of Patent: Apr. 20, 2010

(54) PAPER FEED STRUCTURE FOR AN IMAGE FORMING APPARATUS

(75) Inventors: Takateru Yamamoto, Kyoto (JP); Nobuya Kishi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 447 days.

(21) Appl. No.: 11/374,464

(22) Filed: Mar. 13, 2006

(65) Prior Publication Data

US 2006/0226595 A1 Oct. 12, 2006

(30) Foreign Application Priority Data

Mar. 31, 2005 (JP) ..... 2005-100957

(51) Int. Cl.
*B65H 3/44* (2006.01)

(52) U.S. Cl. ..... 271/9.13; 271/9.01; 271/9.05; 271/162

(58) Field of Classification Search ..... 271/9.01, 271/9.05, 9.13, 162
See application file for complete search history.

(56) References Cited

U.S. PATENT DOCUMENTS 4,053,152 A * 10/1977 Matsumoto ..... 271/9.07
4,688,782 A * 8/1987 Browne ..... 271/9.07
4,729,683 A * 3/1988 Staniszewski ..... 400/624
4,986,522 A * 1/1991 Paulson ..... 271/2
5,100,022 A * 3/1992 Fukudome et al. ..... 221/198
5,201,507 A * 4/1993 Tokuda ..... 271/9.01
5,201,873 A * 4/1993 Kikuchi et al. ..... 271/9.13
5,779,235 A * 7/1998 Nakamura ..... 271/9.09
6,152,561 A * 11/2000 Watanabe ..... 347/104
6,176,481 B1 * 1/2001 Ohkoda ..... 271/9.05
6,189,881 B1 * 2/2001 Bolton et al. ..... 271/9.04
6,325,369 B1 * 12/2001 Strutt ..... 271/9.02
6,371,476 B2 * 4/2002 Isogai et al. ..... 271/3.14
6,526,253 B2 * 2/2003 Hayashi et al. ..... 399/391
7,334,786 B2 * 2/2008 Shinga ..... 271/9.11
7,451,972 B2 * 11/2008 Fukada et al. ..... 271/9.09
7,621,519 B2 * 11/2009 Sagawa et al. ..... 271/4.01
2005/0051942 A1 * 3/2005 Kubo et al. ..... 271/9.09

FOREIGN PATENT DOCUMENTS

JP 04-327446 11/1992
JP 08301476 A * 11/1996
JP 2000016619 A * 1/2000
JP 2002-179267 6/2002
JP 2006282290 A * 10/2006

* cited by examiner

*Primary Examiner*—Patrick Mackey
*Assistant Examiner*—Howard Sanders
(74) *Attorney, Agent, or Firm*—Renner, Otto, Boisselle & Sklar, LLP

(57) ABSTRACT

A paper feed cassette incorporates a storage portion for standard-sized paper and a storage portion for small-sized paper that has an area smaller than the standard-sized paper, further includes paper conveyance paths for guiding the standard-sized paper and small-sized paper from the respective storage portions to an image forming portion, and these paper conveyance paths share a common vertical portion.

15 Claims, 9 Drawing Sheets

[Paper feed cassette of a comparative example]

[STEP2] (Insertion into the paper feed cassette)

Insertion of the postcard storage portion into the paper feed cassette completes coupling with the paper feed roller.

[STEP3] (When standard storage paper is fed out)

FIG.9

[STEP4] (When postcard paper is fed out)

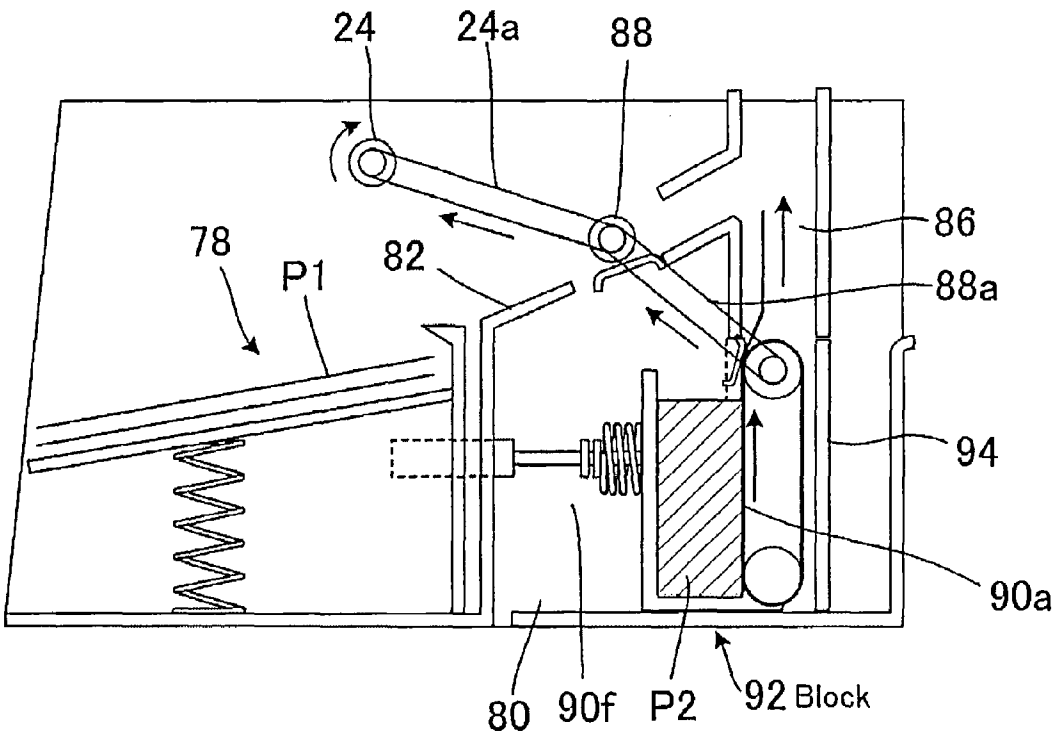

When postcard paper is fed, the paper feed roller is rotated in reverse or in the direction opposite to that when standard storage paper is fed, to rotate the postcard conveyor belt. Further, when the paper is fed, the solenoid is turned off so that the postcard storage portion is pushed out into the conveyance path by the elastic force of the elastic member.

PAPER FEED STRUCTURE FOR AN IMAGE FORMING APPARATUS

This Nonprovisional application claims priority under 35 U.S.C. §119(a) on Patent Application No. 2005-100957 filed in Japan on 31 Mar. 2005, the entire contents of which are hereby incorporated by reference.

BACKGROUND OF THE INVENTION (1) Field of the Invention

The present invention relates to a paper feed structure for use in an image forming apparatus such as a copier, printer facsimile machine, etc., which performs image forming by selectively feeding and conveying paper sheet by sheet from a stack of paper stored at the bottom of the apparatus, transferring an unfixed developer image onto the paper that is fed at a higher position, fusing and fixing the unfixed developer image to the paper at a further higher position, and discharging the paper after fixing upwards or sidewards.

(2) Description of the Prior Art

Conventional image forming apparatuses such as copiers, printers, etc., perform an image forming process comprising the steps of: developing the electrostatic latent image of an original image, written or formed on the photoreceptor drum, with a developer; transferring the developer image to a sheet of paper (recording paper) fed from a paper feed cassette; fixing the developer image thus transferred to the recording paper, by fusing and pressing while nipping it between a heat roller and pressing roller; and discharging the paper.

In this image forming process, multiple kinds of recording paper are used. Of these various kinds of recording paper, postcard paper that is small-sized and thick (usually having a basis weight of 128 g/m$^2$) is not used in a large amount. For this reason, there is not much demand for products with a dedicated paper feed tray for postcard paper, so usually postcard paper is fed through a manual paper feeder mechanism that is separately configured from the paper feed portion with paper feed trays.

Japanese Patent Application Laid-open Hei 4-327446 (Patent document 1) discloses an image forming apparatus that uses a manual paper feeder mechanism. Typically, as described in this patent document 1 a paper conveyance path for a manual paper feeder mechanism is laid out so as to join into the paper conveyance path from the cassettes, at a position before an idle roller for controlling the timing at which paper is delivered to the photoreceptor drum.

Recently, image forming apparatuses having a compact design configuration, front access (meaning a configuration in which almost all control operations of image forming can be made from the front side of the machine) and a buildup system have been developed.

Illustratively, the image forming apparatus includes: a paper feeder that stores paper at the bottom of the apparatus and selectively delivers paper, sheet by sheet, from the paper stored therein; a printing portion for transferring the toner image, which was formed by developing an electrostatic latent image (written by laser beam) on a photoreceptor drum, to the fed paper; a fixing portion for fusing and fixing the unfixed developer image onto the paper; and a paper discharge portion for discharging the paper with the developer image fused and fixed thereon, to a space above the fixing portion or to the side-wall portion of the apparatus.

Nowadays, many kinds of image forming apparatuses have been developed which have a paper feed portion, a printing portion, a fixing portion, a paper discharge portion and an original reading portion arranged one over another from bottom to top of the apparatus.

The image forming apparatus of this type employs a conveying system that has an essentially vertical paper feed path along which recording paper is conveyed upward from the paper feed portion. It is common practice that the aforementioned manual paper feeder mechanism is arranged at a position between the paper feed portion and the printing portion on the exterior of the apparatus.

The path of the paper that is conveyed from the manual paper feed mechanism of this type needs to join to the aforementioned paper conveyance path directed upward, at a position before the printing portion (before the idle roller), so the manually fed paper has to pass through a conveyance path that has a markedly large curvature, compared to the aforementioned conveyance path.

When small-sized sheets such as postcard paper, etc., being thick, hence high in rigidity, are fed to the conveyance path from this manual feeder mechanism, the paper of this kind may stagnate in the conveyance path and may cause the so-called jam problem (jam: paper becomes stuck and unable to move).

The same problem will occur when, other than postcard paper, special thick paper (having a basis weight of 128 g/m$^2$ to 250 g/m$^2$) that is thicker than usual paper (having a basis weight of about 50 to 100 g/m$^2$, for example) is used.

SUMMARY OF THE INVENTION

In view of the above problems, it is an object of the present invention to provide a paper feed structure for an image forming apparatus in which, while paper feed paths for a paper feed cassette disposed at the bottom of the image forming apparatus are formed efficiently in a space saving manner, the paper feed cassette is adapted to enable small-sized paper of a large basis weight, such as postcard paper etc., that is smaller in area than standard paper, to be accommodated in the space inside the apparatus and delivered out straightforward in the substantially vertical direction in the same manner as the standard paper is, to thereby achieve conveyance of small-sized paper free from paper feed jam.

The present invention relates to a paper feed structure for an image forming apparatus.

In accordance with the first aspect of the present invention, a paper feed structure for an image forming apparatus, includes: a paper feed portion for feeding and conveying paper, sheet by sheet, upward, selectively from the paper accommodated in a paper feed cassette arranged at the bottom of the main apparatus body; a printing portion for forming an unfixed developer image on an image bearing member and transferring the unfixed developer image to the fed paper; a fixing portion disposed over the printing portion for fusing and fixing the unfixed developer image onto the paper; and, a paper discharge portion for discharging the paper with the developer image fused and fixed thereon from the top of the fixing portion or from the side wall of the apparatus, and is characterized in that the paper feed cassette in the paper feed portion incorporates a storage portion for predetermined sized paper, a storage portion for small-sized paper having an area that is smaller than the predetermined size, and individual paper conveyance paths for guiding the predetermined sized paper and the small-sized paper from respective storage portions to the printing portion, the paper conveyance paths sharing a common vertical portion.

In the second aspect of the present invention, it is preferred that in the paper feed cassette the storage portion for the predetermined sized paper and the storage portion for the small-sized paper are horizontally arranged side by side, and the common portion shared by the paper conveyance paths for small-sized paper and predetermined sized paper is formed in the upper part of the paper feed cassette.

In the third aspect of the present invention, it is preferred that the storage portion for small-sized paper can be attached to and detached from the paper feed cassette, and when it is attached to the paper feed cassette, a side wall of the storing portion constitutes part of the side wall of the paper feed cassette.

In the fourth aspect of the present invention, it is preferred that the storage portion for small-sized paper has a conveying mechanism for sending out the small-sized paper toward the printing portion located above, and the conveying mechanism for sending out the small-sized paper comprises a conveyor belt that moves along a predetermined vertically arranged track, a drive portion for moving the conveyor belt and a pressing portion for pressing the small-sized paper onto a first side section of the conveyor belt, and while the pressing portion presses a stack of small-sized paper against the first side section, the first side section of the conveyor belt is moved upward by the drive portion so that the small-sized paper is delivered toward the printing portion located above, by friction with the first side section.

In the fifth aspect of the present invention, it is preferred that the drive portion is able to operate in both normal and reverse modes so as to selectively move the conveyor belt upward or downward along the predetermined track.

In the sixth aspect of the present invention, it is preferred that the paper feed structure further includes a drive force transfer portion which provides a drive force for the conveyor belt by transferring the rotational drive force of a mechanism that sends out the predetermined sized paper from the storage portion to the printing portion via the paper conveyance path, and a conveying mechanism for sending out the small-sized paper to the printing portion is driven by a driving force that is transferred by the drive force transfer portion so as to rotate in a direction opposite to the direction of rotation when the predetermined size paper is delivered, so that the first side section of the conveyor belt is moved upwards to thereby send out the small-sized paper to the printing portion via the paper conveyance path.

In the seventh aspect of the present invention, it is preferred that, in the paper feed structure for an image forming apparatus which is constructed such that the storage portion for small-sized paper can be attached to and detached from the paper feed cassette, and when the storage portion is attached to the paper feed cassette, printing with the paper of a third kind that is other than those stored in the paper feed cassette but is fed from below the paper feed cassette can be performed by the printing portion, the paper conveyance path for small-sized paper serves as the paper conveyance path for small-sized paper and also serves as the paper conveyance path for guiding the paper of a third kind that is fed from below the paper feed cassette, upward to the printing portion; and when the small-sized paper is conveyed, the conveyor belt blocks the entrance of the paper of a third kind from below into the paper conveyance path, whereas when the third paper from below is conveyed, the conveyor belt opens the entrance of the third paper.

In the eighth aspect of the present invention, it is preferred that in the part of the paper conveyance path for small-sized paper, located at the side of the storage portion, the second side section of the conveyor belt arranged vertically opposes a guide element, and the paper feed structure further includes: a spacing changer for changing the spacing between the second side section of the conveyor belt and the guide element; and, a conveyance controller that performs conveyance control such that when printing is performed with small-sized paper, the spacing changer causes the conveyor belt to move closer to the guide element and block the third paper entrance from below, and while the pressing portion presses the small-sized paper against the first side section of the conveyor belt, the drive portion moves the first side section of the conveyor belt upwards to convey the small-sized paper by its friction with the first side section upwards to the printing portion through the upper paper conveyance path on the paper feed cassette side.

In the ninth aspect of the present invention, it is preferred that the conveyance controller performs control such that the spacing changer moves the conveyor belt away from the guide element to open the third paper entrance from below when the paper of a third kind is used for printing and controls the drive portion to cause the conveyor belt to drive the first side section of the conveyor belt downwards and the second side section upwards.

In the tenth aspect of the present invention, it is preferred that the small-sized paper accommodated in the paper feed cassette is postcard paper. Here, though postcard paper usually has a basis weight of about 128 g/m$^2$, it goes without saying that postcard paper having a basis weight around it can be included. "Postcard pattern" is not limited to the standardized postcard but can include postcards of various sizes and shapes.

According to the paper feed structures for an image forming apparatus described in the first to tenth aspects of the present invention, since the paper feed portion incorporates a storage portion for standard-sized paper, a storage portion for small-sized paper having an area that is smaller than the predetermined size, and individual paper conveyance paths for guiding the predetermined sized paper and the small-sized paper from the respective storage portions to the printing portion, it is possible to efficiently arrange the paper conveyance paths in the paper feed cassette located at the bottom of the image forming apparatus, in a space-saving manner. Further, since the common portion shared by these two paper conveyance paths is arranged vertically, it is possible to simplify the paper conveyance path arrangement.

Further, this paper feed cassette enables thick small-sized paper of a large basis weight, such as postcard paper etc., that is smaller in area than standard paper, to be accommodated in the space inside the apparatus and to be conveyed straightly along the substantially vertical path in the same manner as the standard paper is, hence this configuration is markedly effective in achieving conveyance of small-sized paper free from paper feed jam.

In the individual aspects, the operations and effects as follows can be obtained in addition to the above operation and effect.

In accordance with the second aspect, since in the paper feed cassette the storage portion for the predetermined sized paper and the storage portion for the small-sized paper are horizontally arranged side by side, it is possible to provide the storage portion and paper conveyance path for small-sized paper, utilizing the unchanged dimensions of the conventional paper feed cassette without the need of a greater vertical dimension of the paper feed cassette. Further, since the common portion shared by the two paper conveyance paths for small-sized paper and predetermined sized paper is formed at the upper part of the paper feed cassette, provision of a single paper conveyance path on the image forming apparatus side is good enough to simplify the apparatus configuration.

In accordance with the third aspect, the storage portion for small-sized paper is constructed so that it can be attached to and separated from the paper feed cassette and when it is attached to the paper feed cassette, the side wall of the storage portion constitutes part of the side wall of the paper feed cassette. Therefore, this configuration makes it possible for the storage portion for small-sized paper to be taken out from the paper feed cassette and loaded with a stack of small-sized paper, and also provides an integral form when it is fitted in place to the paper feed cassette, hence improves external appearance quality.

In accordance with the fourth aspect, the storage portion for small-sized paper has a conveying mechanism that sends out the small-sized paper toward the printing portion located above, and when the pressing portion presses a stack of small-sized paper against the first side section of the conveyor belt, the first side section of the conveyor belt is moved upward by the drive portion so that the small-sized paper is sent out toward the printing portion located above, by the friction thereof with the first side section. Accordingly, the small-sized paper can be tightly abutted against the conveyor belt so as to obtain high enough frictional force to thereby convey the paper to the printing portion above in a reliable manner, and it is also possible to prevent paper feed failures hence positively prevent occurrence of paper feed jam.

In accordance with the fifth and sixth aspects, since the drive portion is able to operate in both normal and reverse modes so as to selectively move the conveyor belt upward or downward along the predetermined track, it is possible to positively feed the small-sized paper when the belt moves upwards and to positively stop the feed of small-sized paper when the belt moves downwards.

In accordance with the seventh aspect, since the paper conveyance path for small-sized paper provides both the functions of the paper conveyance path for small-sized paper and the paper conveyance path for guiding the third paper that is conveyed from the bottom of the paper feed cassette upward to the printing portion, the arrangement of the paper conveyance paths can be simplified. Further, since the conveyor belt blocks the entrance for the third paper from below into the paper conveyance path when the small-sized paper is conveyed and the conveyor belt opens the third paper entrance when the third paper from below is conveyed, it is not only possible to use the paper conveyance path for small-sized paper as the paper conveyance path for the third paper, but also possible to eliminate the risk of the small-sized paper and the third paper being conveyed at the same time, hence positively preventing the occurrence of paper jam.

In accordance with the eighth aspect, since, in the part of the paper conveyance path for small-sized paper, located at the side of the storage portion, the second side section of the conveyor belt arranged vertically opposes a guide element, and a spacing changer for changing the spacing between the second side section of the conveyor belt and the guide element is provided, the second side section of the conveyor belt serves as a constituent of the paper conveyance path, which leads to structural simplification. Further, a conveyance controller is provided which performs conveyance control such that when printing is performed with small-sized paper, the spacing changer causes the conveyor belt to move closer to the guide element and block the third paper entrance from below, and while the pressing portion pushes the small-sized paper against the first side section of the conveyor belt, the drive portion moves the first side section of the conveyor belt upwards to convey the small-sized paper by its friction with the first side section upwards to the printing portion through the upper paper conveyance path on the paper feed cassette side. Accordingly, in addition to the effectiveness in preventing paper feed jam of the invention of the seventh aspect, it is possible to convey the small-sized paper in a reliable manner since a great frictional force can be acted on the paper.

In accordance with the ninth aspect, since the conveyance controller performs control such that the spacing changer moves the conveyor belt away from the guide element to open the third paper entrance from below when the paper of a third kind is used for printing and controls the drive portion to cause the conveyor belt to drive the first side section downwards and the second side section upwards, the paper conveyance path for the third paper becomes wide and the second side section of the conveyor belt functions as an upward moving guide, thereby making it possible to smoothly convey the third paper upwards to the printing portion.

BRIEF DESCRIPTION OF THE DRAWINGS

FIG. 9 is an illustrative view showing a state where paper is delivered from a storage portion for small-sized paper.

DESCRIPTION OF THE PREFERRED EMBODIMENTS

Now, the embodiment of a drive control unit of a drive roller of an image forming apparatus of the present invention will be described in detail with reference to the drawings shown in FIGS. 1 to 9.

Figure 1:
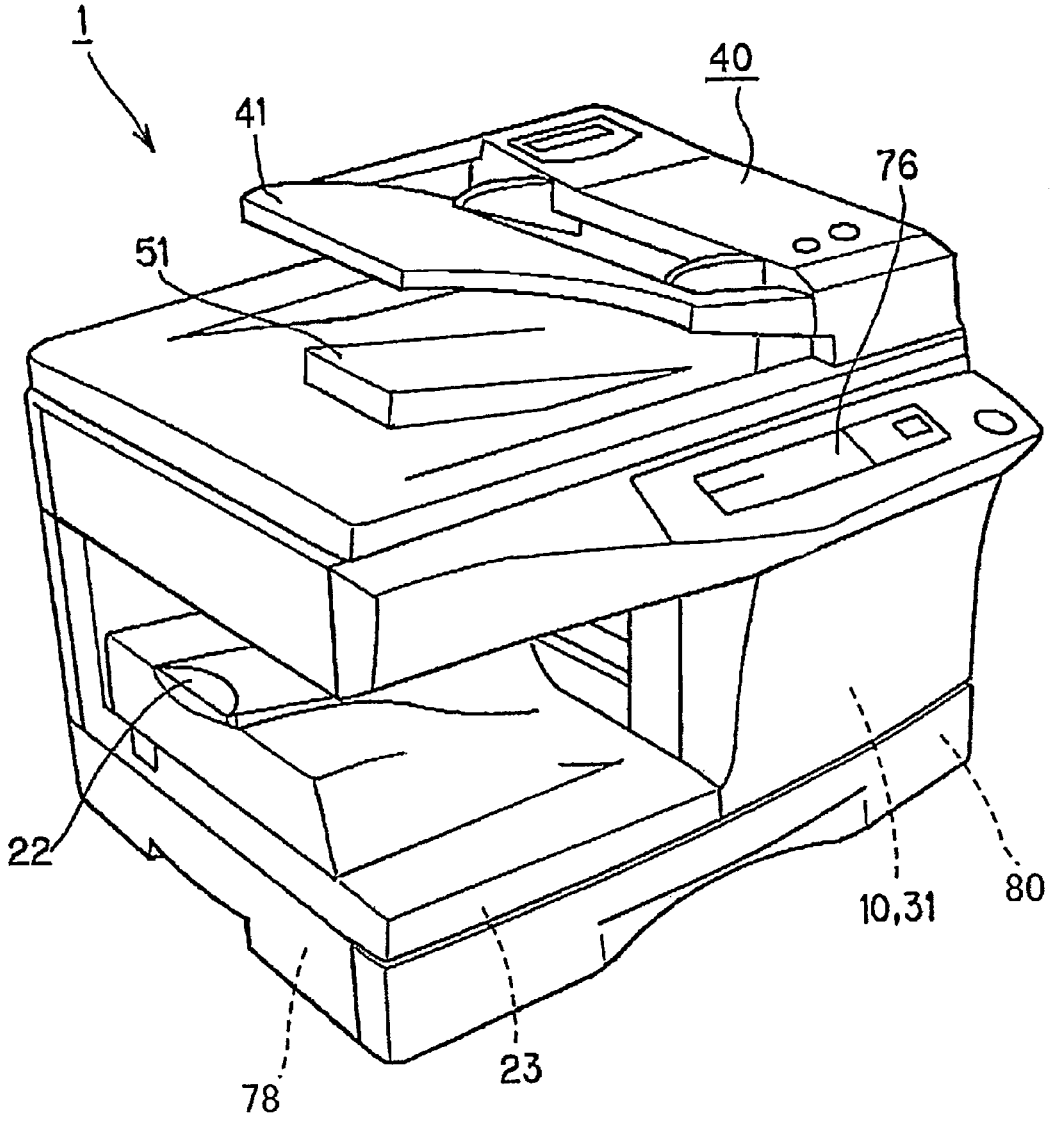
FIG. 1 is an illustrative view showing an overall external configuration of an image forming apparatus in the embodiment of a paper feed structure for an image forming apparatus according to the present invention.
Figure 2:
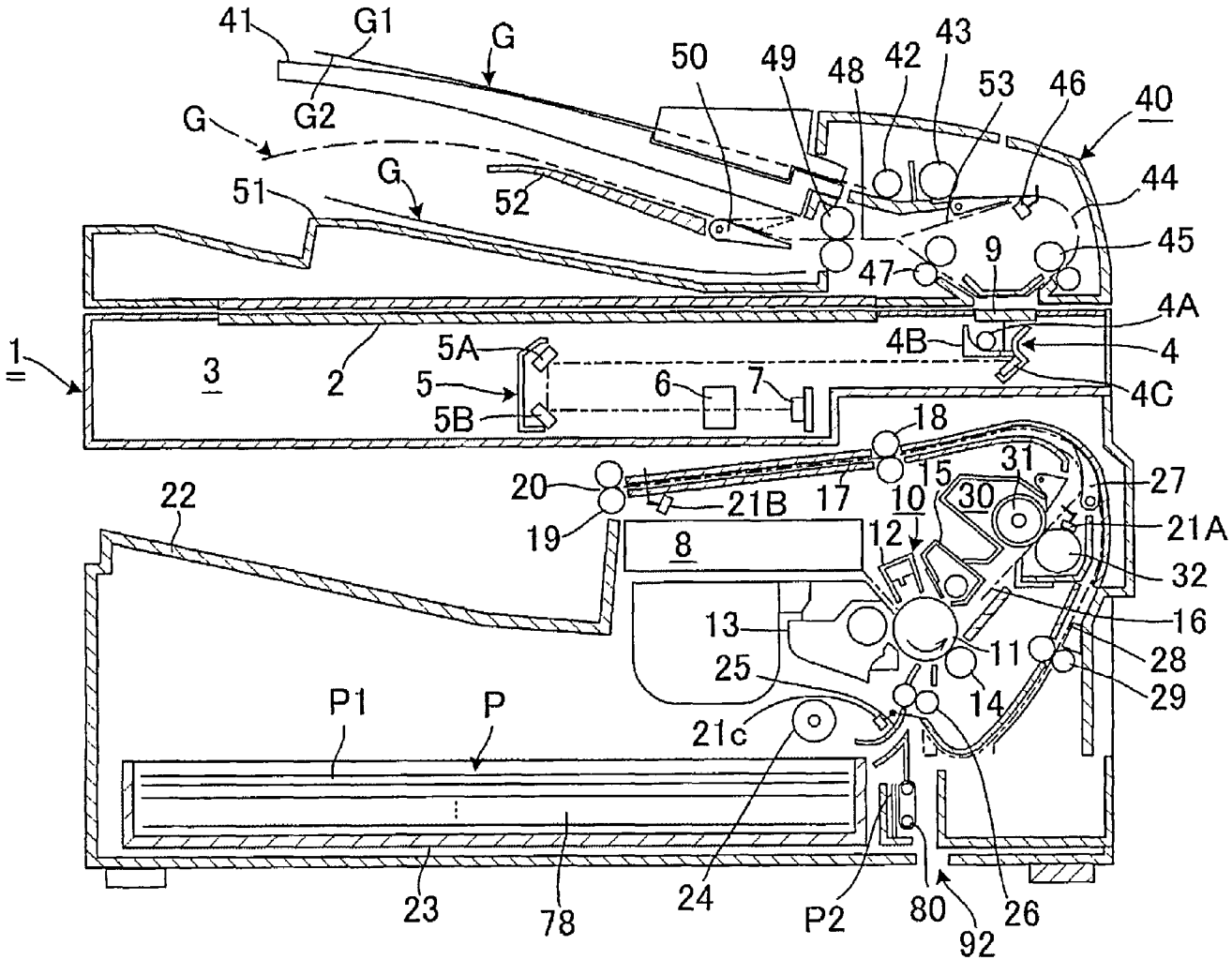
FIG. 2 is an illustrative sectional view schematically showing the internal configuration of the image forming apparatus of FIG. 1.
Figure 3:
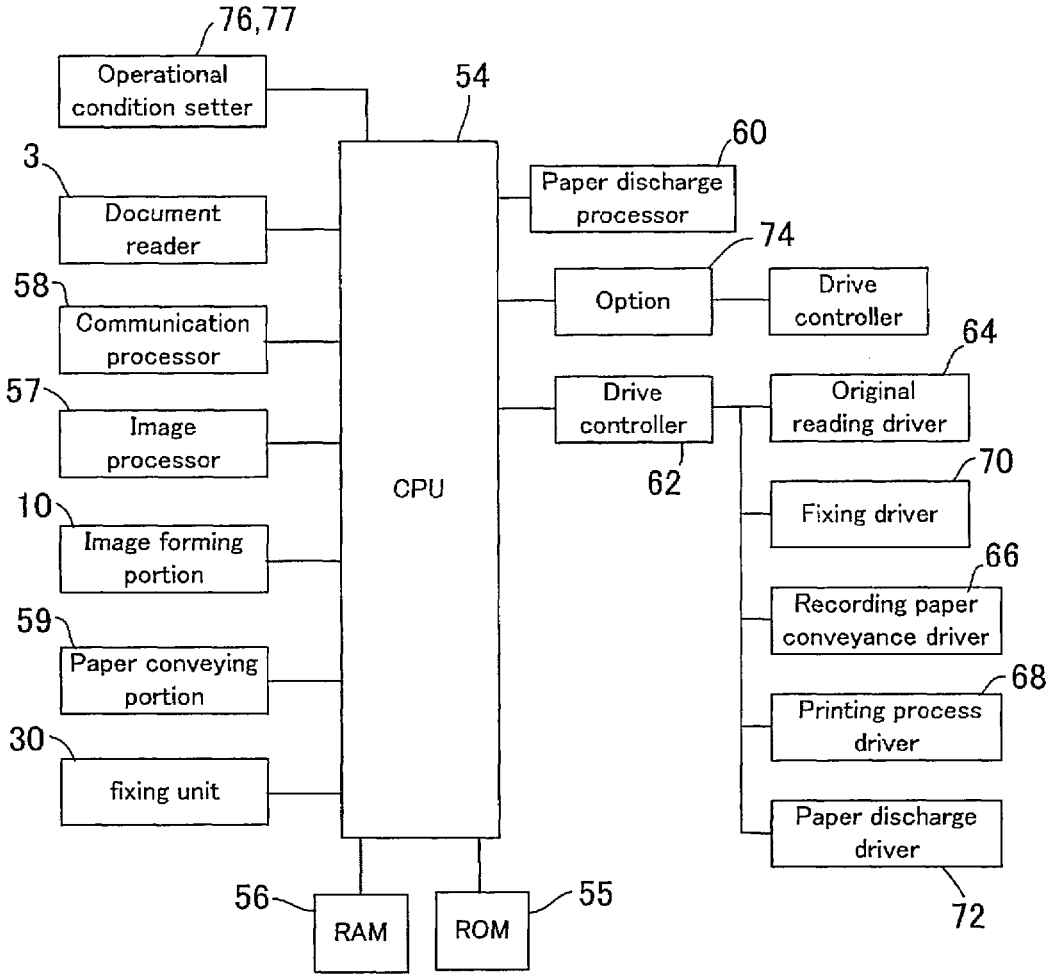
FIG. 3 is a control block diagram showing the electric control system of the image forming apparatus of FIG. 1.

FIG. 1 shows an overall external configuration of an image forming apparatus according to the embodiment of the present invention; FIG. 2 shows an internal configuration of the image forming apparatus; and FIG. 3 shows control blocks in the electric control system of the image forming apparatus. A reference numeral 1 designates a main apparatus body (machine body).

As shown in FIGS. 1 to 3, an original placement table 2 made of transparent glass, on which an original is placed, is provided on the top of the main apparatus body 1. A scanner portion 3 as a document reader for capturing image information of an original G is arranged under the original placement table 2.

This image forming apparatus includes: a paper feed portion for feeding and conveying paper, sheet by sheet, upward, selectively from paper P1 and paper P2 (standard-sized paper P1 and small-sized paper P2: also called recording paper P) accommodated in a paper feed cassette 23 arranged at the bottom of the main apparatus body 1; an image forming portion (corresponding to "printing portion") 10 for forming an unfixed developer image on a photoreceptor drum (corresponding to "image bearing member") 11 and transferring the unfixed developer image to the fed paper; a fixing unit (corresponding to "fixing portion") 30 disposed over image forming portion 10 for fusing and fixing the unfixed developer image to the paper; and a paper discharge processor (corresponding to "paper discharge portion") 60 arranged over fixing unit 30 or at the side wall of the apparatus for discharging the paper with the developer image fused and fixed thereon.

[Scanner Portion 3]

Scanner portion 3 is composed of an original image reading unit including a first scan unit 4 and a second scan unit 5 that are arranged under original placement table 2 and reciprocate in parallel thereto, and an optical lens element 6; a photoelectric transducer (CCD) 7. In FIG. 2, the light path in scanner portion 3 is shown by the chain line.

First scan unit 4 includes an exposure lamp 4A, a reflector 4B for guiding the light from exposure lamp 4A to the original image surface and a first mirror 4C for leading the reflected light image that is obtained by exposing the original via reflector 4B and being reflected off the original, in a predetermined direction, and is controlled so as to move back and forth at a predetermined scan speed, keeping itself parallel to and a predetermined distance from, the underside of original placement table 2.

Second scan unit 5 includes a second mirror 5A and a third mirror 5B for leading the reflected light image from the original by way of first mirror 4C of first scan unit 4 in the predetermined direction and is controlled so as to move back and forth parallel to the first scan unit 4 and at a speed related to the speed of the first scan unit.

Optical lens element 6 is laid out on the light path of the reflected light from the original image, downstream of third mirror 5B of second scan unit 5 so that the light image is focused on photoelectric transducer 7.

This photoelectric transducer (e.g., CCD (charge coupled device)) 7 captures the light image of the original image, focused by optical lens element 6 and photoelectrically converts it into an electric signal to thereby create original image information (original image data). This original image information is output to an image processing portion 57.

[Image Processing Portion 57]

Image processing portion 57 subjects the original image information output from photoelectric transducer 7 to image processes and produces printing image information (printing image data) so that the resolution, density, etc., will be suited for printing. The printing image information obtained as a result of the image processes is sent to the image data input portion of a laser scanning unit (LSU) 8.

[Image Forming Portion (Printing Portion) 10]

Then, laser scanning unit 8 emits laser beams in accordance with the printing image information output from image processing portion 57 over the surface of photoreceptor drum 11 as a constituent of image forming portion (image forming process) 10. In this way, an electrostatic latent image of the printing image information is written and formed on photoreceptor drum 11.

In image forming portion 10, the printing portion is realized by developing the electrostatic latent image formed on the photoreceptor drum 11 surface with the developer to form a visual image (unfixed developer image) and transferring that unfixed developer image to the fed paper.

Detailedly, photoreceptor drum 11 is rotationally driven in the direction of the arrow. Arranged around photoreceptor drum 11 are a main charger 12 for charging the photoreceptor drum 11 surface at a predetermined potential, laser scanning unit 8 for emitting laser beams for forming an electrostatic latent image on the photoreceptor drum 11 surface, a developing unit 13 for developing the electrostatic latent image formed by illumination of the laser beams from laser scanning unit 8 with a developer of toner etc., a transfer roller 14 for transferring the toner image of the original image that has been visualized by the developing unit 13 to a sheet of paper (also called recording paper or print paper) P fed through a paper feed path 25 from paper feed cassette 23 detailed later, and a cleaning device 15 for cleaning the leftover toner remaining on the photoreceptor drum 11 after the transfer with transfer roller 14, all being arranged in the rotational direction of photoreceptor drum 11 in the order mentioned.

Main charger 12 of image forming portion 10 also has the function of unillustrated charge erasing device for erasing charge on the photoreceptor drum 11 surface after cleaning by cleaning device 15.

[Fixing Unit 30]

The recording paper P with a toner image transferred thereon as it being nipped between photoreceptor drum 11 and transfer roller 14, is separated from the photoreceptor drum 11 surface and further conveyed along a main conveyance path 16 to fixing unit 30 where the paper enters between a heat roller (drive roller) 31 and pressing roller (an element opposing the drive roller) 32. A nip is formed at the contact between heat roller 31 and pressing roller 32 by a predetermined pressing force.

In fixing unit 30, the recording paper P held between heat roller 31 and pressing roller 32, i.e., at the nip, is heated by heat roller 31 and pressed by pressing roller 32 so that the unfixed toner image that has been transferred from photoreceptor drum 11 is fixed to the paper.

Recording paper P after fixing by this fixing unit 30 is conveyed along a paper discharge path 17 toward a paper discharge roller 19 on the paper discharge port 20 side by a paper discharge drive roller 18.

[Paper Discharge Processor (Paper Discharge Portion) 60]

Paper discharge processor 60 discharges the paper with a developer image fused and fixed thereon to a space above the fixing unit or to the side-wall portion of apparatus body 1.

Detailedly, recording paper P conveyed through paper discharge path 17 is detected by a fixing detection switch 21A arranged downstream of fixing unit 30 when the paper passes through the nip between heating roller 31 and pressing roller 32.

For a case of usual one-sided printing, the paper is directly conveyed by the rotational drives of paper discharge drive roller 18 and a paper discharge roller 19 and discharged through paper discharge port 20 onto a paper output cassette 22 which is disposed in a space under scanner portion 3. The passage status of recording paper P through paper discharge roller 19 is detected by a paper discharge detecting switch 21B arranged upstream of paper discharge roller 19.

Recording paper P is conveyed along the side of the image forming portion 10 and discharged to the space over paper feed cassette 23 and under scanner portion 3, to the top of fixing unit 30, to the side-wall portion of the apparatus body 1, or the like.

Figure 4:
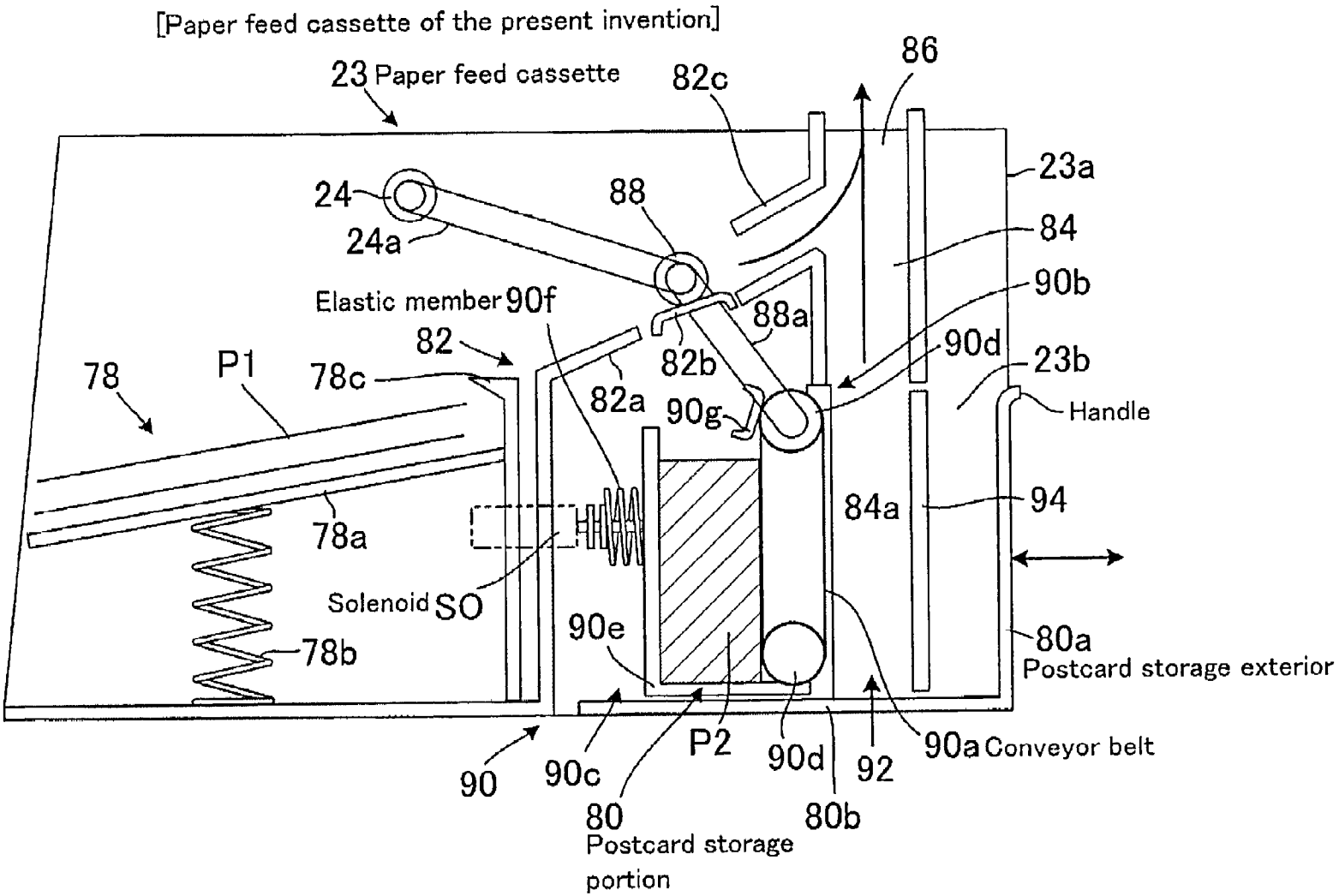
FIG. 4 is an illustrative view showing the detailed configuration of a paper feed cassette and paper conveying portion provided at the bottom of the main apparatus body according to the present invention.
Figure 5:
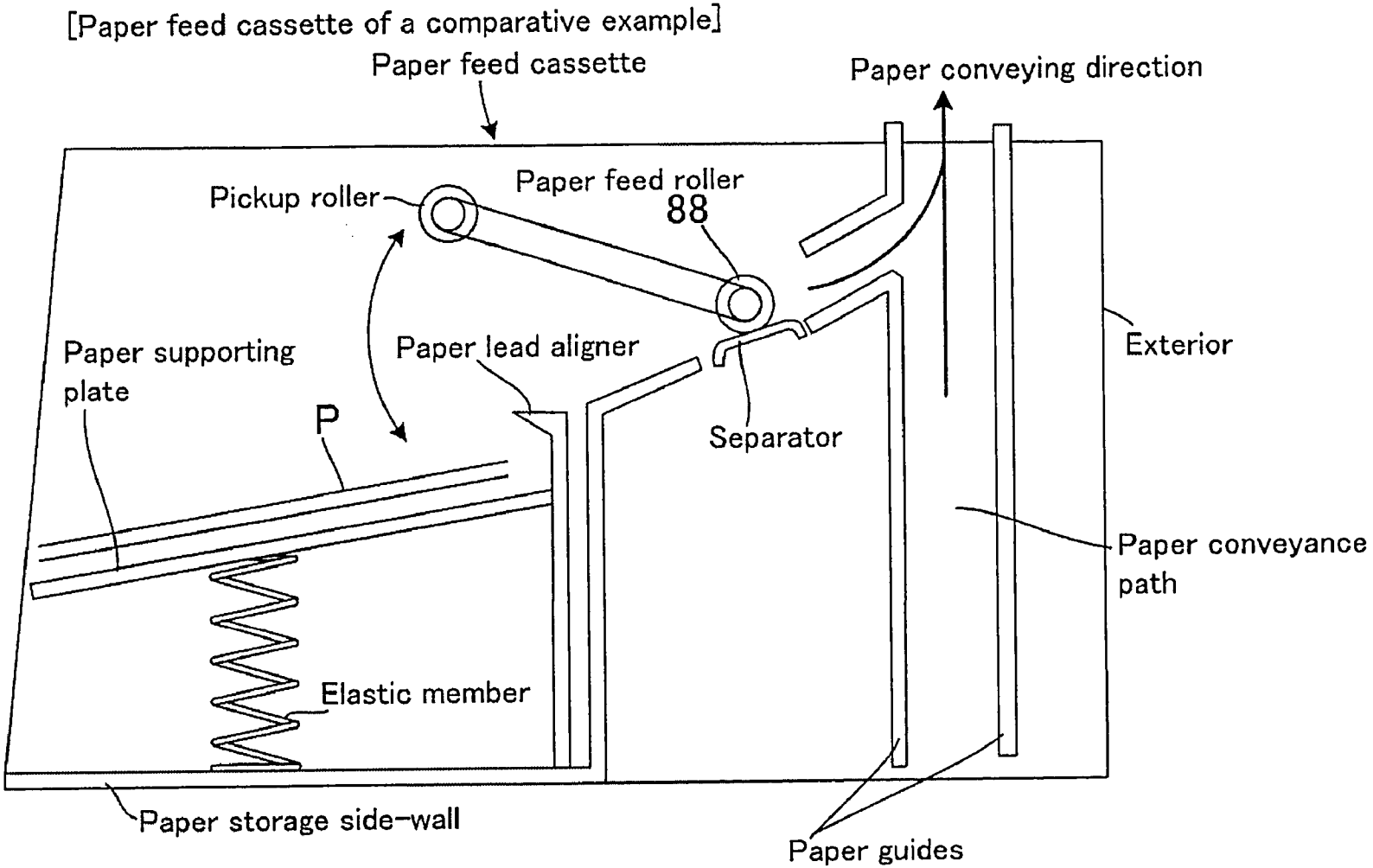
FIG. 5 is an illustrative view showing a comparative example where no storage portion for small-sized paper such as postcard paper, etc. shown in FIG. 4 is provided.

FIG. 4 is an illustrative view showing the detailed configuration of paper feed cassette 23 and paper conveying portion 59, arranged under the apparatus body 1 according to the present invention. FIG. 5 is an illustrative view showing a comparative example where no storage portion 80 for postcard paper (small-sized paper P2) shown in FIG. 4 is provided. FIGS. 6 to 9 are illustrative views showing the states of the postcard storage portion from its fitting to delivery of postcard paper.

[Paper Feed Cassette 23 and Paper Conveying Portion 59 (Paper Feed Portion)]

Arranged at the inner bottom of main apparatus body 1 is an exchangeable paper feed cassette 23, in which a stack of recording paper P of a predetermined paper size is accommodated. A pickup roller 24 is arranged over the paper delivering side of this paper feed cassette 23.

The paper feed cassette and paper conveying portion 59 constitute a paper feed portion that holds papers (P1, P2) in paper feed cassette 23 provided at the bottom of main apparatus body 1 and selectively delivers paper, sheet by sheet, upward from the stacked sheets.

Paper feed cassette 23 of the paper feed portion has a storage portion 78 for standard-sized paper (predetermined sized paper) P1 conforming to the Japan Industrial Standard, such as A series paper including A4 size etc., and B series paper including B4, B5 sizes etc., and a storage portion 80 for small-sized paper P2 such as postcard paper etc., having a smaller area than that of the standard-sized paper.

Provided further in paper feed cassette 23 are paper conveyance paths 82 and 84 for guiding standard-sized paper P1 and small-sized paper P2 from storage portions 78 and 80 into image forming portion 10. Paper conveyance paths 82 and 84 share a common vertical portion 86.

Detailedly, the essential parts around the paper delivery side of paper feed cassette 23 are shown in FIG. 4.

As shown in FIG. 4, paper feed cassette 23 has a horizontally flat, essentially open-top box-shaped configuration. This paper feed cassette 23 has storage portion 78 for standard-sized paper P1 and storage portion 80 for small-sized paper P2, arranged horizontally side by side. In the embodiment these storage portions 78 and 80 are laid out left and right when main apparatus body 1 is viewed from the side of control switches 76. The common portion 86 shared by paper conveyance paths 82 and 84 for standard-sized paper P1 and small-sized paper P2 is formed in the upper part of paper feed cassette 23.

[Storage Portion 78 for Standard-sized Paper P1 and its Paper Conveyance Path 82]

Storage portion 78 for standard-sized paper P1 has a horizontally flat, top-open box-shaped configuration, in which a base plate 78*a* for receiving a stack of paper P1 is formed at the bottom while an elastic member 78*b* such as a spring etc. that presses the base plate 78*a* upward to urge (lift) paper P1 in the thickness direction, is disposed between the bottom and base plate 78*a*.

The standard-sized paper P1 in the storage portion 78 is delivered out sidewards and slightly upwards from left to right. At the exit side of paper P1 a paper lead aligner 78*c* that abuts and aligns the leading ends of lifted paper P is provided, and the exit side is connected to a paper conveyance path 82 sloping upward from left to right.

Here, pickup roller 24 for picking up standard-sized paper P1 from storage portion 78 is constructed so as to move up and down (in the embodiment it pivots up and down about an aftermentioned paper feed roller 88), and picks up the paper, sheet by sheet, from the topmost of a stack of standard-sized paper P1 in paper feed cassette 23 and sends out the paper downstream (for convenience' sake, the delivery side of standard-sized paper P1 (the cassette side) is referred to as upstream and the direction of conveyance is referred to as downstream) to paper conveyance path 82. The paper P1 delivered to paper conveyance path 82 is adapted to reach a registration roller (also called "idle roller") 26 in paper feed path 25 that extends to the aforementioned image forming portion 10.

The paper conveyance path 82 is constituted of a lower-side slope 82*a* of a plate member, a separator 82*b* arranged halfway through the slope 82*a* and a connecting portion 82*c* that is a plate-like member disposed parallel to the exit side of slope 82*a* and connected to the aforementioned common portion 86.

A cylindrical paper feed roller 88 is arranged over and opposing separator 82*b*. In this arrangement paper feed roller 88 and separator 82*b* hold standard-sized paper P1 from above and below, so that paper feed roller 88 comes from top into contact with the top surface of paper P1 and delivers paper P1 as it rotates.

Separator 82*b* has a surface texture presenting suitable friction so as to provide the function of preventing multiple sheets of paper P1 from being delivered out by being in frictional contact with the lower surface of paper P1 when paper P is sent out by paper feed roller 88.

Pickup roller 24 is adapted to receive a rotational driving force transferred from the paper feed roller 88 by means of a timing belt 24*a* made of elastic material such as rubber etc., hence rotates in synchronization with the roller 88, thus making it possible to feed paper P1 without any wrinkle, slack or the like.

Connecting portion 82*c* is formed so as to extend sloping from left to right and join to common portion 86 that extends vertically, forming an integral portion of an essentially "inverted Y" shape.

Since the paper feed structure of the image forming apparatus of the embodiment, is comprised of paper feed cassette 23 that incorporates storage portion 78 for standard-sized paper P1 and storage portion 80 for small-sized paper P2 that is smaller in area than standard-sized paper P1 and paper conveyance paths 82 and 84 for guiding standard-sized paper P1 from storage portion 78 and small-sized paper P2 from storage portion 80 toward image forming portion 10, it is possible to efficiently arrange paper conveyance paths 82 and 84 in paper feed cassette 23 located at the bottom of the image forming apparatus, in a space-saving manner. Further, since the common portion 86 that is shared by paper conveyance paths 82 and 84 is arranged vertically, it is possible to simplify the arrangement of paper conveyance paths 82 and 84.

Further, this paper feed cassette 23 enables thick small-sized paper P2 of a large basis weight, such as postcard paper etc., that is smaller in area than standard paper, to be accommodated in the space inside the apparatus and to be conveyed straightly along the substantially vertical path in the same manner as the standard paper is, hence it is possible to achieve conveyance of small-sized paper free from paper feed jam.

Also, since in paper feed cassette 23 storage portion 78 for standard-sized paper P1 and storage portion 80 for small-sized paper P2 are arranged left and right in the horizontal direction, it is possible to provide storage portion 80 and paper conveyance path 84 for small-sized paper P2, utilizing the unchanged dimensions of the conventional paper feed cassette without the need of a greater vertical dimension of paper feed cassette 23.

For example, as shown in FIG. 5, in a comparative example where no storage portion 80 for small-sized paper is provided, there is a space under paper conveyance path 82 for standard-sized paper P1. Provision of the above-described storage portion 80 in this space makes it easy and possible to construct storage portion 80 and paper conveyance path 84 for small-sized paper P2 in the conventional paper feed cassette of the above comparative example, or in a configuration similar to this.

Since common portion 86 that is shared by paper conveyance paths for small-sized paper P2 and standard-sized paper P1 is formed at the upper part of paper feed cassette 23, provision of a single paper conveyance path on the image forming apparatus side is good enough to simply the apparatus configuration.

[Storage Portion 80 for Small-sized Paper P2 and its Paper Conveyance Path 84]

The storage portion 80 for small-sized paper P2 is adapted to be attached to and separated from paper feed cassette 23, and when it is attached to paper feed cassette 23, a side wall 80*a* of storage portion 80 constitutes part of a side wall 23*a* of paper feed cassette 23.

Formation of storage portion 80 for small-sized paper in the above way facilitates storage portion 80 to be taken out from paper feed cassette 23 and loaded with a stack of small-sized paper P2, and also provides an integral form when it is fitted in place to paper feed cassette 23, hence improves external appearance quality.

The storage portion 80 for small-sized paper P2 has a conveying mechanism 90 that sends out small-sized paper P2 toward image forming portion (printing portion) 10 located above.

Specifically, the conveying mechanism 90 for sending out small-sized paper P2 is comprised of a conveyor belt 90*a* that moves along a predetermined vertically arranged track, a drive portion 90*b* for moving conveyor belt 90*a* and a pressing portion 90*c* for pressing small-sized paper P2 onto the first side section of the conveyor belt.

Conveyor belt 90*a* is wound between pulleys 90*d* and 90*d* arranged at the top and bottom.

Drive portion 90*b* is adapted to circulate conveyor belt 90*a* selectively in one direction or the other, by transferring the rotational drive force of the paper feed roller 88 to pulleys 90*d* and 90*d* through a timing belt 88*a* (drive force transfer portion) made of elastic material such as rubber etc. that is wound on the axle etc. of pulley 90*d*. The predetermined vertical track is constituted by the path that is connected between the outer peripheries of pulleys 90*d* and 90*d* in the embodiment. Specifically, in FIG. 4 the track is formed of the left side path that is located on the storage portion 78 for standard-sized paper P1 and the right side path that moves along the opposite side. A separator 90*g* that prevents multiple sheet delivery of small-sized paper P2 by the function of frictional force is arranged on the upper left side of conveyor belt 90*a* and opposing the belt. When small-sized paper P2 is delivered from the storage portion, the paper is held between conveyor belt 90*a* and separator 90*g* and sent out into paper conveyance path 84.

Pressing portion 90*c* is comprised of a holder member 90*e* that has a vertical section of an L-shape, i.e., is open on the conveyor belt side so as to hold a stack of small-sized paper P2 upright resting thereon, and an elastic member 90*f* such as a spring etc. for urging the holder member 90*e* against conveyor belt 90*a*.

Storage portion 80 is formed of a horizontal base plate 80*b* and the aforementioned side wall 80*a* that stands upright on the side from which it is drawn out, and these elements are supported and reinforced with an unillustrated frame. The aforementioned pulleys 90*d* and 90*d* are axially and rotationally supported by the frame. Holder member 90*e* is arranged so as to move horizontally (left and right) on base plate 80*b*, advancing toward or retracting from conveyor belt 90*a*. Elastic member 90*f* is fixed on its one end to the storage portion 78 side (the reciprocating rod of a solenoid SO) for standard-sized paper P1 in paper feed cassette 23 while the other end is arranged so as to urge holder member 90*e* in the horizontal direction toward the small-sized paper P2 side.

When this pressing portion 90*c* presses a stack of small-sized paper P2 set on the holder member 90*e* by means of elastic member 90*f* against the first side section (the left side surface in FIG. 4) of conveyor belt 90*a*, the first side section of the conveyor belt 90*a* is moved upward by the drive portion so that small-sized paper P2 can be sent out toward image forming portion (printing portion) 10 located above, by its friction with the first side section of the belt.

In the above way, since the first side section of the conveyor belt 90*a* is moved upward by drive portion 90*b* so that small-sized paper P2 can be sent out toward image forming portion (printing portion) 10 located above, by its friction with the first side section of the belt, it is possible to abut small-sized paper P2 against conveyor belt 90*a* so as to obtain high enough frictional force to thereby convey the paper to the printing portion above in a reliable manner. Further, since the paper can be separated by separator 90*g*, it is possible to positively prevent paper feed failures and occurrence of paper feed jam.

Paper feed roller 88 can be driven to rotate in normal and reverse directions. Accordingly, the drive portion is adapted to drive in normal and reverse modes so that conveyor belt 90*a* can selectively move upward or downward along the predetermined track, by transferring drive force via timing belt 88*a*.

In this way, drive portion 90*b* is able to operate in normal and reverse modes so as to selectively move conveyor belt 90*a* upward or downward, along the predetermined track that is formed by pulleys 90*d* and 90*d*. Accordingly, it is possible to positively deliver small-sized paper P2 when the belt moves upwards and to positively stop the feed of small-sized paper P2 when the belt moves downwards.

Further, as described above, when the rotational drive force of paper feed roller 88 for sending out standard-sized paper P1 from storage portion 78 to the printing portion via paper conveyance path 82 is transferred to the drive portion for axles of pulleys 90*d* and 90*d*, it is transferred to the timing belt (drive force transfer portion) 88*a* for driving conveyor belt 90*a*. The conveying mechanism 90 for sending out the small-sized paper P2 toward image forming portion (printing portion) 10 is driven by the drive force that is transferred via timing belt (drive force transfer portion) 88*a* so as to move in the direction opposite to that when the standard-sized paper P1 is delivered or so that the first side section of conveyor belt 90*a* is moved upwards to thereby send out small-sized paper P2 along paper conveyance path 84 to the printing portion.

Here, the image forming apparatus of the embodiment is constructed so that storage portion 80 for small-sized paper P2 can be attached to and separated from paper feed cassette 23 and so that image forming portion (printing portion) 10 is able to perform printing of paper of a third kind that is other than those stored in paper feed cassette 23 but is fed from below paper feed cassette 23.

Paper conveyance path 84 for small-sized paper P2 not only functions as the paper conveyance path for small-sized paper but also provides the function of the paper conveyance path for guiding the paper of a third kind that is fed from below paper feed cassette 23 upward to the printing portion; when small-sized paper P2 is conveyed, conveyor belt 90*a* blocks the entrance, designated at 92, for the third paper from below into paper conveyance path 84, whereas when the third paper from below is conveyed, conveyor belt 90*a* opens the third paper entrance 92.

In this way, since paper conveyance path 84 for small-sized paper P2 also functions as the paper conveyance path for guiding the third paper upward to the printing portion, the arrangement of the paper conveyance paths can be simplified. Further, since conveyor belt 90*a* blocks entrance 92 for the third paper from below into paper conveyance path 84 when small-sized paper P2 is conveyed and conveyor belt 90*a* opens the third paper entrance 92 when the third paper from below is conveyed, it is not only possible to use the paper conveyance path 84 for small-sized paper P2 as the paper conveyance path for the third paper, but also possible to eliminate the risk of small-sized paper P2 and the third paper being conveyed at the same time, hence positively preventing the occurrence of paper jam.

The aforementioned paper conveyance path 84 has a portion 84*a* that extends under the aforementioned common portion 86 and is located at the side of storage portion 80. This portion 84*a* is defined between the second side section (the surface on the right side in FIG. 4) of conveyor belt 90*a* and a guide element 94, which both extend vertically and oppose each other, and is provided with a spacing changer for varying the spacing between the second side section of conveyor belt 90*a* and guide element 94.

Here, in storage portion 80, conveyor belt 90*a*, pulleys 90*d* and 90*d* on which the conveyor belt is wound, holder member 90*e* and separator 90*g* are integrally assembled with their relative positions kept constant or essentially constant. As conveyor belt 90*a* is moved closer to guide element 94 by means of the spacing changer (moved in the right direction in FIG. 4), holder member 90*e* is pushed by pressing portion 90*c* so as to urge small-sized paper P2 in holder member 90*e* against conveyor belt 90*a* with an appropriate pressure, which will not hinder conveyance of paper P2.

With this arrangement, the second side section of conveyor belt 90*a* is adapted to serve as a constituent of paper conveyance path 84, which leads to structural simplification.

In the embodiment the spacing changer is an actuator such as a solenoid SO etc. that shifts conveyor belt 90*a* left and right. The turning on and off of this actuator is controlled in accordance with the input setting of the paper type through control switches 76, so that it is turned on when paper P1 or the third paper is selected (FIG. 8) and off when paper P2 is selected (FIG. 9).

In this case, when printing is performed with small-sized paper P2, the spacing changer moves conveyor belt 90*a* closer to guide element 94 so as to block the third paper entrance 92 from below and so that pressing portion 90*c* pushes small-sized paper P2 against the first side section (the left side surface) of conveyor belt 90*a*.

At the same time, a drive controller (conveyance controller) 62 performs control in accordance with instructions from a CPU 54 such that the drive portion moves the first side section of the conveyor belt 90*a* upwards so that small-sized paper P2 is conveyed by the friction with the first side section upwards to the printing portion through the upper paper conveyance path, i.e., the common portion 86 on the paper feed cassette 23 side.

When the third paper is used for printing, drive controller (conveyance controller) 62 performs control such that the spacing changer moves conveyor belt 90*a* away from guide element 94 so as to open the third paper entrance 92 from below and the drive portion drives conveyor belt 90*a* so that the first side section of conveyor belt 90*a* moves downwards while the second side section moves upwards.

As described above, the apparatus includes drive controller (conveyance controller) 62 that performs control such that when printing is performed with small-sized paper P2, the spacing changer causes conveyor belt 90*a* to move closer to guide element 94 and block the third paper entrance 92 from below, and while pressing portion 90*c* pushes small-sized paper P2 against the first side section of conveyor belt 90*a*, drive portion 90*b* moves the first side section of the conveyor belt 90*a* upwards to convey small-sized paper P2 by the friction with the first side section upwards to the image forming portion (printing portion) 10 through the upper paper conveyance path on the paper feed cassette 23 side. Accordingly, in addition to the effect for preventing the occurrence of paper jam, it is possible to convey small-sized paper P2 reliably because a strong enough frictional force acts on the paper.

Further, since drive controller (conveyance controller) 62 causes the spacing changer to move conveyor belt 90*a* away from guide element 94 so as to open the third paper entrance 92 from below as descried above when the third paper is used for printing, the paper conveyance path for the third paper becomes wide and the second side section of conveyor belt 90*a* functions as an upward moving guide. As a result it is possible to smoothly convey the third paper upwards to the printing portion.

Here, it is preferred that the small-sized paper P2 stored in the paper feed cassette 23 is postcard paper as stated above.

Here, a pre-registration detection switch 21C is arranged on the upstream side of registration roller 26. This pre-registration detection switch 21C detects recording paper P that is fed and conveyed from paper feed cassette 23. Paper feed to the aforementioned image forming portion 10 is adapted to be performed by adjusting the paper feed timing based on this signal.

On the other hand, when duplex printing is performed, after printing by image forming portion 10 has been performed on one side of recording paper P, the recording paper P is sent into paper discharge path 17 after passage through fixing unit 30, then once conveyed to the paper discharge roller 19 side. In this condition, a paper switching gate 27 is changed over, then paper discharge roller 19 is driven in reverse so that the recording paper P is switched back and guided into sub conveyance path 28 for reversing the paper.

Then, the thus guided recording paper P is rotationally driven by a sub-drive roller 29 provided on this sub conveyance path 28 and conveyed to the upstream side of registration roller 26, so that printing on the other side of recording paper P is performed.

On original placement table 2 of main apparatus body 1 an automatic document processor 40 of a document feed type reversing automatic document feeder (R-SPF), for example, is mounted so that it can be opened and closed to also serve as an original placement cover.

As shown in FIG. 2, this automatic document processor 40 has a document tray 41 on which originals G are set. The originals G set on this document tray 41 are picked up, one by one, by a document pickup roller 42 so that original G is guided by a document drive roller 43 through a document conveyance path 44 and conveyed to the upstream side of a registration roller (PS roller) 45.

A document input sensor 46 for detecting the document size of original G is arranged on the upstream side of the registration roller 45. This document input sensor 46 detects the leading end and trailing end of original G. Conveyance of original G to a document reading station 9, formed of a glass slit and arranged adjacent to one side of document placement table 2, is controlled by adjusting the timing based on the detection of this signal.

In this case, first scan unit 4 of scanner portion 3 is controlled so that it is positioned ready to go under document reading station 9.

As to the scan of original G that is fed onto this document reading station 9, one side of the original, namely, the first image-scan side G1 is scanned by first scan unit 4 of scanner portion 3 while the original is being moved. Other operations such as image reading by photoelectric transducer 7, the image processing of the image information, the image forming process including printing etc., are performed in the same manner as above.

The original G that has been scanned through document reading station 9 is conveyed by a conveyance roller 47 through document discharge path 48 toward the document discharge roller 49 side. When document reading is performed for one side only, the document is discharged onto a document output tray 51 by the switching control of a document switching gate 50.

On the other hand, when document reading is performed for both sides, by the switching control with document switching gate 50 original G is once discharged onto a middle tray 52 disposed between document tray 41 and document output tray 51, then is switched back into a document reversing path 53 by driving document discharge roller 49 in reverse. This original G is once again fed into document conveyance path 44 so that the original image on the underside of original G facing the image reader is scanned while the original image on the underside of original G is printed out on the first printing side of recording paper P in the same manner as in the above-described one-side printing operation.

When this printing operation for the first printing side of recording paper P has been finished, recording paper P is reversed by the above-described sheet reversing device, then fed again into image forming portion 10 so that the original image on the front side of original G that has been previously stored in the memory is printed on the second printing side.

As shown in FIG. 1, control switches 76 for allowing the user to set up the image forming conditions such as sheet type of recording paper P (sheet thickness etc., in addition to sheet size), print number, magnification, density etc., are arranged on the front portion on the upper side of the image forming apparatus.

Referring next to FIG. 3, the control system of the image forming apparatus according to the embodiment will be described.

As shown in FIG. 3, the image forming apparatus according to the embodiment performs processes such as image reading, image processing, image forming and conveyance of recording paper P, etc., by a central processing unit (CPU) 54 which performs control in accordance with the program stored beforehand in a ROM (read only memory) 55, using temporal storage such as a RAM (random access memory) 56 etc. It is also possible to use other storage such as a HDD (hard disk drive) etc., instead of ROM and RAM.

In the image forming apparatus, the image information of an original (original image data) captured by scanner portion (original reading portion) 3, or original image information transmitted from other terminal devices connected via an unillustrated communication network, is adapted to be input to an image processing portion 57 by way of a communication processor 58.

Image processor 57 shapes the original image information stored in the storage such as RAM 56 or the like into a printing image that is suitable for printing (image forming onto recording paper), in accordance with the aforementioned program.

The printing image information is input to image forming portion 10.

Image forming portion 10, paper conveying portion (performing various detections and controls of recording paper P in paper feed path 25, main conveyance path 16, sub conveyance path 28 (these are also called paper guides)) 59, fixing unit 30 and paper discharge processor (performing various detections and controls of recording paper P in paper discharge path 17) 60 are linked with respective drive controllers.

Paper conveying portion 59 conveys recording paper P so through a printing stage (printing process of image information in image forming portion 10) and a fixing stage (at fixing unit 30) for the recording paper P having been processed with printing and then discharges it to paper discharge portion (paper output cassette 22). Here, paper conveying portion 59 receives detection signals from the aforementioned pre-registration detection switch 21C, fixing detection switch 21A and paper discharge detecting switch 21B.

The image forming apparatus has an operational condition setter 77. This operational condition setter 77 sets up operational conditions for image forming and conditions of conveyance etc., in the image forming apparatus, in accordance with the image forming request and the image forming conditions such as the type of recording media etc., designated by the user through control switches 76.

Further, in the image forming apparatus, based on the set operating conditions, drive controller 62 is adapted to control drive actuators for the aforementioned reading portion (scanner portion 3), paper conveying portion 59, image forming portion 10, fixing unit 30, paper discharge processor 60 etc., namely, an original reading driver 64, a recording paper conveyance driver 66, a printing process driver 68, a fixing driver 70 and a paper discharge driver 72 so that they can operate in synchronization with instructions from CPU 54 in accordance with the program stored in ROM 55.

Original reading driver 64 is a drive actuator for the first scan unit 4 and the second scan unit 5 of scanner portion 3.

Recording paper conveyance driver 66 means paper conveying portion 59, specifically, drive motors for paper feed roller 88 (pickup roller 24, paper discharge belt 90*a*) and registration roller 26 along the aforementioned paper feed path 25. Printing process driver 68 is a drive motor for photoreceptor drum 11. Fixing driver 70 is of drive motors for heat roller 31 and pressing roller 32 in fixing unit 30. Paper discharge driver 72 is of drive motors for paper discharge drive roller 18, paper discharge roller 19 etc. All these drive motors for drivers may be driven by common or different motors with appropriate power transmission mechanisms.

Further, the image forming apparatus may be used with optional configurations 74 including post-processors (stapler, puncher, multi-bin paper output trays, shifter, etc.), automatic document reader (automatic document processor 40 etc.), large-volume paper feed cassettes and the like. These optional configurations 74 incorporate individual controllers separately from the controller of the image forming apparatus so as to operate in synchronization with the main apparatus by performing timing adjustment via the aforementioned communication processor 58.

Referring next to FIGS. 6 to 9, the operation of the paper feed structure of the image forming apparatus according to the embodiment will be described.

Figure 6:
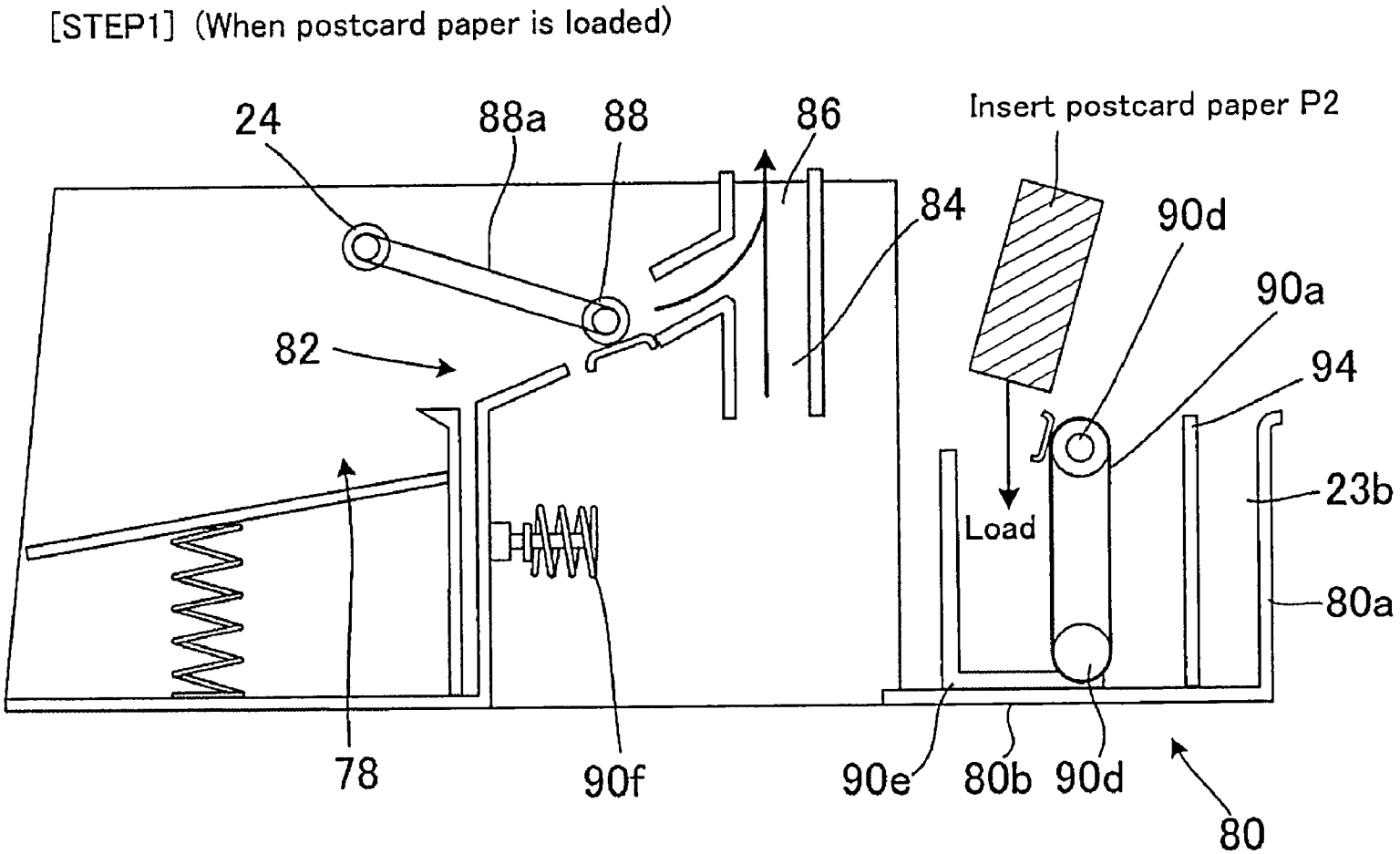
FIG. 6 is an illustrative view showing a state where small-sized paper is set (loaded) in the storage portion in the image forming apparatus of FIG. 1.

To begin with, as shown in FIG. 6, storage portion 80 for small-sized paper P2 is drawn out from side wall 23*a* of paper feed cassette 23. In this case, a cutout hollow 23*b* is partially formed in the interior side of side wall 80*a* of storage portion 80 allowing the user to fit the hand into hollow 23*b* and provides for the user a handhold for pulling out.

With storage portion 80 drawn out, a stack of small-sized paper P2 is loaded vertically (with the paper P2's surface set vertically) between conveyor belt 90*a* and holder member 90*e*.

Though not illustrated, when storage portion 80 has been drawn out, timing belt 88*a* wound between paper feed roller 88 and drive portion 90*b* of pulley 90*d* is stretched out together with storage portion 80 due to its expandability. It is of course possible to provide a configuration such that timing belt 88*a* can be disengaged or to use another drive transfer mechanism other than the timing belt, which can be disengaged.

Figure 7:
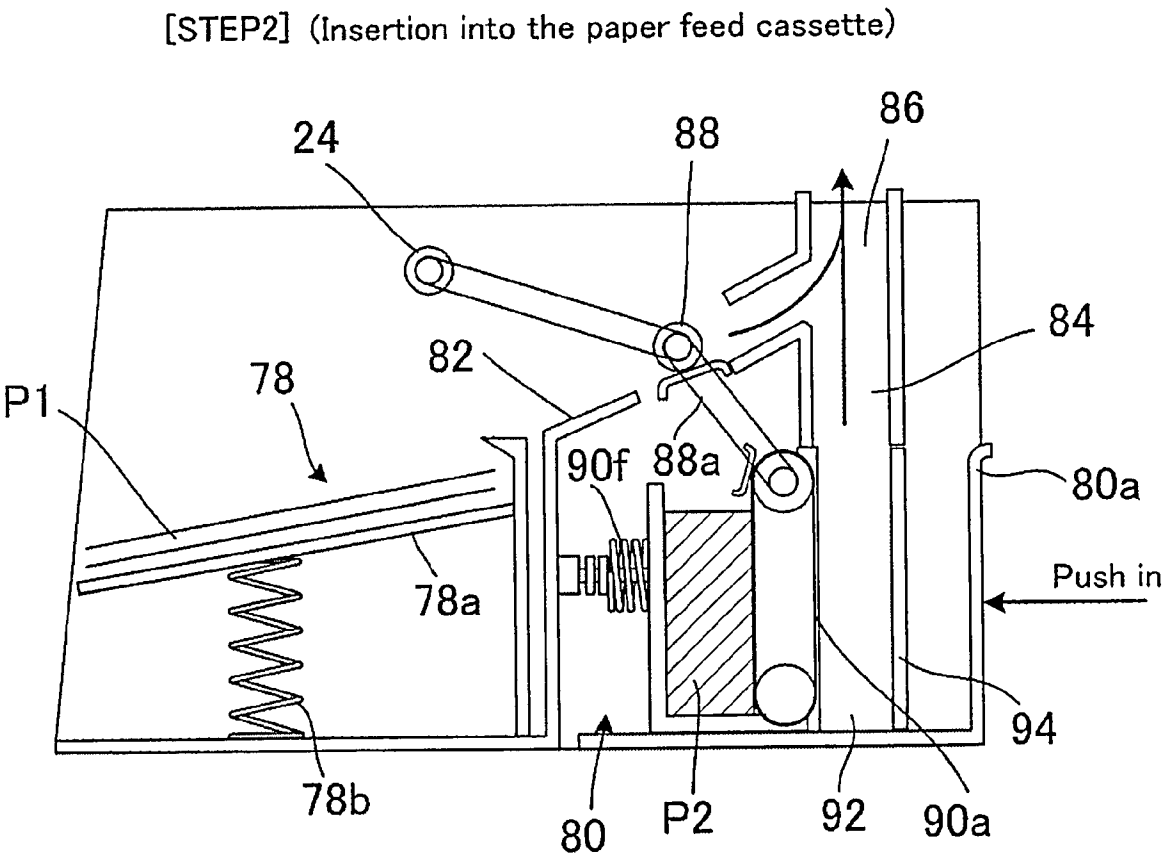
FIG. 7 is an illustrative view showing a state where a storage portion for small-sized paper is fitted to a paper feed cassette.

Next, as shown in FIG. 7, storage portion 80 filled with small-sized paper P2 is pushed into paper feed cassette 23 and set and fixed in place. That is, paper conveyance path 84 is made correspondent to common portion 86, and holder member 90*e* is pressed by elastic member 90*f*, so that small-sized paper P2 is positively urged against conveyor belt 90*a* while timing belt 88*a* is set so that drive force can be correctly transferred between paper feed roller 88 and pulley 90*d*. Thus, preparations for the printing operation are completed.

When the user operates control switches 76 to input a printing request signal for standard-sized paper P1 or small-sized paper P2 or a printing request for a third kind of paper, paper is conveyed from storage portion 78 or 80 in the following manner.

[A Printing Request for Standard-sized Paper P1]

Figure 8:
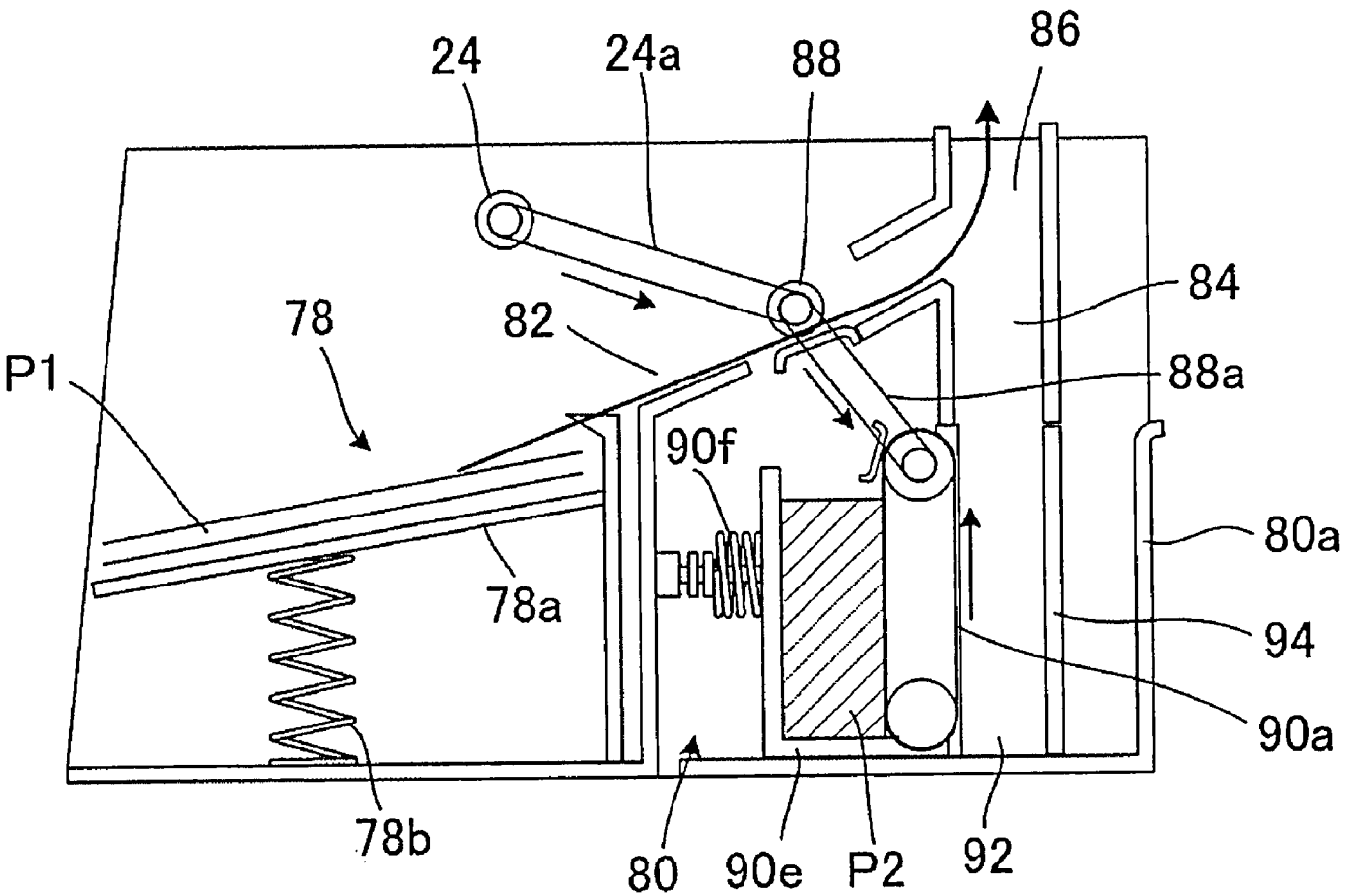
FIG. 8 is an illustrative view showing a state where paper is delivered from a storage portion for standard-sized paper.

When a printing request for standard-sized paper P1 is made, pickup roller 24 pivots downwards to standard-sized paper P1 side first and comes into contact with paper P1, as shown in FIG. 8. Pickup roller 24 rotates counterclockwise in FIG. 8 to deliver out standard-sized paper P1 to paper conveyance path 82.

In paper conveyance path 82, when the leading end of the delivered standard-sized paper P1 reaches paper feed roller 88, the paper P1 is held between paper feed roller 88 and separator 82*b*. Then this standard-sized paper P1 advances rightwards and upwards along conveyance path 82 by the counterclockwise rotation of paper feed roller 88 with the multiple delivery of sheets prevented, then passing upwards through common portion 86 in the paper conveyance passage toward image forming portion 10 which is a printing portion.

The driving force of paper feed roller 88 in the counterclockwise direction is transferred to conveyor belt 90*a* by means of timing belt 88*a*, and conveyor belt 90*a* also circularly driven counterclockwise by the driving force. When conveyor belt 90*a* circulates counterclockwise, the left side track of conveyor belt 90*a* moves downwards. Accordingly, this produces downward force that acts on small-sized paper P2 and pushes it against holder member 90*e*, so that paper P2 will not move in storage portion 80. On the other hand, the right side track of conveyor belt 90*a* moves upwards.

When printing for a third kind of paper is requested, pickup roller 24 is pivoted upward so as to keep itself out of contact with standard-sized paper P1. Then, paper feed roller 88 is rotationally driven counterclockwise so that conveyor belt 90*a* is circularly driven counterclockwise by means of timing belt 88*a*.

With this arrangement, conveyor belt 90*a* moves upwards as it is in contact with the third kind of paper that passes paper conveyance path 84, realizing smooth conveyance.

[A Printing Request for Small-sized Paper P2]

When a printing request for small-sized paper P2 is made, conveyor belt 90*a* is shifted closer to guide element 94 (moved in the right direction in FIG. 4) by the spacing changer constituted of an unillustrated actuator, as shown in FIG. 9. With this movement, entrance 92 located under paper conveyance path 84 is blocked by conveyor belt 90*a* so that it is possible to prevent the third kind of paper from being fed, hence prevent occurrence of paper jam.

Holder member 90*e* is pushed by elastic member 90*f* so as to urge small-sized paper P2 held in holder member 90*e* against conveyor belt 90*a* with an appropriate pressure.

Further, pickup roller 24 is pivoted upward so as to keep itself out of contact with standard-sized paper P1. Then, paper feed roller 88 is rotationally driven clockwise so that conveyor belt 90*a* is circularly driven clockwise by means of timing belt 88*a*.

Accordingly, small-sized paper P2 is moved upward by the frictional force with conveyor belt 90*a*, then is held between conveyor belt 90*a* and separator 90*g*, so that the paper is delivered, sheet by sheet while being perverted from multiple sheet delivery, and sent from paper conveyance path 84 to common portion 86 to image forming portion (printing portion) 10 located above.

Further, paper feed roller 88 is rotated clockwise in FIG. 9, and the driving force of paper feed roller 88 is transmitted to pickup roller 24 by way of timing belt 24*a*. That is, pickup roller 24 rotates clockwise, so if pickup roller 24 touches standard-sized paper P1, the standard-sized paper will not be sent out. Further, if standard-sized paper P1 remains on paper conveyance path 82, the paper is returned by the clockwise rotation to the storage portion 78 side, so as to prevent occurrence of paper jam.

The paper feed structure of the image forming apparatus of the present invention is not limited to the above-described embodiment. Various changes and modifications can be made therein without departing from the scope of the present invention. For example, the small-sized paper is not limited to postcard paper, and the basis weight of paper is not limited as long as the paper has a size smaller than the predetermined sized paper.

What is claimed is:

1. A paper feed structure for an image forming apparatus, comprising:

a paper feed portion for feeding and conveying paper, sheet by sheet, upward, selectively from the paper accommodated in a paper feed cassette arranged at the bottom of the main apparatus body;

a printing portion for forming an unfixed developer image on an image bearing member and transferring the unfixed developer image to the fed paper;

a fixing portion disposed over the printing portion for fusing and fixing the unfixed developer image onto the paper; and, a paper discharge portion for discharging the paper with the developer image fused and fixed thereon from the top of the fixing portion or from the side wall of the apparatus, wherein the paper feed cassette in the paper feed portion incorporates:

(i) a storage portion for storing predetermined sized paper in a generally horizontal orientation, (ii) a storage portion for storing small-sized paper in a generally vertical orientation, the small-sized paper having an area that is smaller than the predetermined sized paper, and (iii) individual paper conveyance paths for guiding the predetermined sized paper and the small-sized paper from respective storage portions to the printing portion, the paper conveyance paths sharing a common vertical portion, wherein the paper feed portion includes a conveying mechanism for delivering the predetermined sized paper out from the storage portion for storing predetermined sized paper in a generally sidewards direction and then vertically through the common vertical portion to the printing portion, and a conveying mechanism for delivering the small-sized paper out from the storage portion for storing small-sized paper in a generally vertical direction through the common vertical portion to the printing portion, wherein the common vertical portion shared by the paper conveyance paths for small-sized paper and predetermined sized paper is formed in the upper part of the paper feed cassette.

2. The paper feed structure for an image forming apparatus according to claim 1, wherein in the paper feed cassette the storage portion for the predetermined sized paper and the storage portion for the small-sized paper are horizontally arranged side by side.

3. The paper feed structure for an image forming apparatus according to claim 1, wherein the storage portion for small-sized paper is detachable from the paper feed cassette, and wherein a side wall of the storing portion constitutes part of the side wall of the paper feed cassette.

4. The paper feed structure for an image forming apparatus according to claim 1, wherein the small-sized paper accommodated in the paper feed cassette is postcard paper.

5. The paper feed structure of claim 1, wherein the storage portion for the predetermined sized paper includes a base plate for receiving the predetermined sized paper and an elastic member for pressing the base plate upwards, and the storage portion for storing small-sized paper includes a base plate, a holder member, and an elastic member arranged to move the holder member horizontally on the base plate.

6. The paper feed structure of claim 1, wherein the storage portion for the small-sized paper is below the conveyance path for the standard-sized paper.

7. The paper feed structure of claim 6, wherein the storage portion for the small-sized paper is between a sidewall of the storage portion for the predetermined-sized paper and a first side section of a conveyor belt for sending the small-sized paper toward the printing portion located above.

8. The paper feed structure of claim 1, wherein the conveyance path for the predetermined-sized paper is upwardly sloped to the common vertical portion and the conveyance path for the small-sized paper is vertically aligned with the common vertical portion.

9. The paper feed structure of claim 1, wherein the small-sized paper has a width that is less than a width of the predetermined-sized paper, and the predetermined-sized paper and the small-sized paper are arranged in the paper cassette such that the width of the predetermined-sized paper is perpendicular to the width of the small-sized paper.

10. The paper feed structure for an image forming apparatus according to claim 1, wherein the storage portion for small-sized paper has a conveying mechanism for sending out the small-sized paper toward the printing portion located above, and the conveying mechanism for sending out the small-sized paper comprises a conveyor belt that moves along a predetermined vertically arranged track, a drive portion for moving the conveyor belt and a pressing portion for pressing the small-sized paper onto a first side section of the conveyor belt, and while the pressing portion presses a stack of small-sized paper against the first side section, the first side section of the conveyor belt is moved upward by the drive portion so that the small-sized paper is delivered toward the printing portion located above, by friction with the first side section.

11. The paper feed structure for an image forming apparatus according to claim 10, wherein the drive portion is able to operate in both normal and reverse modes so as to selectively move the conveyor belt upward or downward along the predetermined track.

12. The paper feed structure for an image forming apparatus according to claim 10, further comprising a drive force transfer portion which provides a drive force for the conveyor belt by transferring the rotational drive force of a mechanism that sends out the predetermined sized paper from the storage portion to the printing portion via the paper conveyance path, wherein a conveying mechanism for sending out the small-sized paper to the printing portion is driven by a driving force that is transferred by the drive force transfer portion so as to rotate in a direction opposite to the direction of rotation during delivery of the predetermined size paper, so that the first side section of the conveyor belt is moved upwards to thereby send out the small-sized paper to the printing portion via the paper conveyance path.

13. The paper feed structure for an image forming apparatus according to claim 10, wherein the storage portion for small-sized paper is detachably fitted to the paper feed cassette in order that the storage portion can be attached to and detached from the paper feed cassette, and printing with the paper of a third kind that is other than those stored in the paper feed cassette but is fed from below the paper feed cassette can be performed by the printing portion, wherein the paper conveyance path for small-sized paper serves as the paper conveyance path for small-sized paper and also serves as the paper conveyance path for guiding the paper of a third kind that is fed from below the paper feed cassette, upward to the printing portion; wherein the conveyor belt is movable between a first position and a second position, and in the first position, the conveyor belt blocks the entrance of the paper of a third kind from below into the paper conveyance path, and in the second position, the conveyor belt opens the entrance of the paper of the third kind.

14. The paper feed structure for an image forming apparatus according to claim 13, wherein in the part of the paper conveyance path for small-sized paper, located at the side of the storage portion a second side section of the conveyor belt arranged vertically opposes a guide element, further comprising:

a spacing changer for changing the spacing between the second side section of the conveyor belt and the guide element; and a conveyance controller that performs conveyance control such that when printing is performed with small-sized paper, the spacing changer causes the conveyor belt to move closer to the guide element and block the third paper entrance from below, and while the pressing portion presses the small-sized paper against the first side section of the conveyor belt, the drive portion moves the first side section of the conveyor belt upwards to convey the small-sized paper by its friction with the first side section upwards to the printing portion through the upper paper conveyance path on the paper feed cassette side.

15. The paper feed structure for an image forming apparatus according to claim 14, wherein the conveyance controller performs control such that the spacing changer moves the conveyor belt away from the guide element to open the third paper entrance from below when the paper of a third kind is used for printing and controls the drive portion to cause the conveyor belt to drive the first side section of the conveyor belt downwards and the second side section upwards.

* * * * *